United States Patent [19]

Davis et al.

[11] Patent Number: 4,976,166

[45] Date of Patent: Dec. 11, 1990

[54] ELECTRONIC FOOT PEDAL

[75] Inventors: Jeffrey L. Davis, Tigard; Jay D. Byler, Beaverton, both of Oreg.

[73] Assignee: Dana Corporation, Toledo, Ohio

[21] Appl. No.: 290,980

[22] Filed: Dec. 28, 1988

[51] Int. Cl.[5] ..... G05G 1/14; H01C 10/00

[52] U.S. Cl. ..... 74/512; 74/560; 74/526; 338/153

[58] Field of Search ..... 74/560, 513, 514, 512, 74/526; 338/153, 108, 47, 113; 180/65.1

[56] References Cited

U.S. PATENT DOCUMENTS

| | | | |
|---|---|---|---|
| 2,192,714 | 3/1940 | Norman et al. | 338/153 X |
| 2,762,891 | 9/1956 | Hill et al. | 338/153 X |
| 3,210,712 | 10/1965 | Goff | 74/560 X |
| 4,087,776 | 5/1978 | Donato | 74/512 X |
| 4,528,590 | 7/1985 | Bisacquino et al. | 74/512 X |
| 4,695,819 | 9/1987 | Bowsher | 74/512 |

OTHER PUBLICATIONS

Foot Pedal Assembly Drawing, 1 p., Feb. 1987.

*Primary Examiner*—Rodney M. Lindsey
*Attorney, Agent, or Firm*—Robert L. Harrington

[57] ABSTRACT

An electronic foot pedal for diesel engine control systems. The pedal provides a voltage signal to a diesel engine electronic fuel control system in response to the drivers demand for engine power. Disclosed is an accelerator pedal assembly containing a potentiometer and pedal interfacing components which provide a voltage signal proportional to pedal position. The pedal assembly is an integral unit which is cab mounted and connected to the engine fuel control via an appropriate wiring harness. An idle stop pin provides a positive pedal idle position. When the idle stop pin is removed, the bias spring load forcing the pedal toward idle is relieved allowing easy assembly of the device.

2 Claims, 1 Drawing Sheet

ELECTRONIC FOOT PEDAL

FIELD OF THE INVENTION

The present invention generally relates to control for engines associated with vehicles, and in particular, the present invention is concerned with electronic fuel controls systems that provide an electrical signal to diesel engine electronic fuel control systems in response to the drivers demand for engine power.

BACKGROUND OF THE INVENTION

Electronic fuel control devices that provide an electrical signal in response to the drivers demand for engine power are known in the art. Known devices comprise generally a potentiometer that is linked to a foot pedal by mechanical linkage to provide an electrical signal proportional to the rotational position of the potentiometer. Prior art devices in general have the potentiometer remotely located from the foot pedal, and connecting linkages such as rods, bell cranks, cables etc., are employed to link the pedal to the potentiometer. These linkages are a potential source of poor transmission of pedal position and are prone to have performance degradation due to wear, contamination, bending, and binding. In addition, the linkage requires a great deal of maintenance and introduces friction and wear in the linkage joints producing looseness and backlash resulting in degradation of the signal generated.

In most prior art devices the potentiometer is placed in the engine compartment which exposes the potentiometer to a hostile enviroment where heat, vibration, and grime hasten the deterioration of the control system.

Idealy, a 20 degree rotation of the foot pedal is optimum for driver comfort and degree of control. A potentiometer using only 20 degrees rotation from minimum signal to maximum signal has less signal resolution over the extent of the potentiometers travel. Preferably, 40 to 60 degrees of potentiometer shaft rotation produces a high quality of voltage signal. The ideal foot pedal control eliminates all lost motion between pedal movement and potentiometer movement. In addition the ideal electronic foot pedal control will place no side load or thrust load on the potentiometer shaft which would induce wear and early failure.

The present invention overcomes the above problems by providing an integrated package with a foot pedal and potentiometer which can be conveniently located in the cab of the vehicle. The present invention provides a three to one multiplication of pedal rotation to potentiometer shaft rotation. In addition the present invention provides an interference fit between the rotating shaft of the foot pedal device and the potentiometer shaft eliminating all lost motion.

SUMMARY OF THE INVENTION

The present invention which, will be described in detail hereinafter, comprises a foot pedal assembly for generating an electrical signal which is representative of the angular position of the foot pedal. The device includes a base to which the pedal is pivotalbly mounted at one end. A lever arm is pivotalbly mounted between a pair of downwardly extending ears formed on the pedal. The lever arm includes a roller supported at one end to the lever arm which engages the base. A pivot pin is fixily attached to the end of the lever arm and is supported by bearings mounted in the downwardly extending ears of the pedal. Depressing the pedal downward causes the roller to move along the track and rotate the lever arm and the pivot pin. A slot formed in the end of the piviot pin snuggly engages a plastic tang formed in the end of the potentiometer rotor to transmit the rotation of the pivot pin to the potentiometer without lost motion.

A torsional spring means urges the lever arm toward an idle position, and a projection on the lever arm engages a stop pin extending between the ears of the pedal to define the idle position of the device. A precision ball bearing supports the pivot pin and absorbs radial and thrust loads of the pedal preventing these loads from being transmitted to the potentiometer, this improves the potentiometers precision and usefull life. A sleeve bearing at the other end of the pivot pin centers the pivot pin and partially supports the radial load of the pedal.

An electrical cable is the only connection required between the electronic foot pedal and the engine. The foot pedal can be conveniently mounted in the less hostile environment of the cab while the engine is free of linkages between the engine and the cab. A pedal bias spring gently urges the pedal toward full throttle position to keep the roller in contact with the base when the vechile is traversing rough terrian and the operators foot may not be on the pedal. The pedal bias spring has a bias load substantially lighter than the bias load of the lever arm bias spring so that it does not over power the lever arm. The lever arm is rotated only by depressing the pedal.

This invention provides an electrical signal to diesel engine electronic fuel control systems in response to the drivers demand for engine power. This pedal assembly is an integral unit which is cab mounted and connected to the engine fuel control via only appropriate wiring connections.

All of the elements of the foot pedal assembly are assembled into one unit which is easily cab mounted.

The present invention eliminates all rods, rod ends, bell cranks, cables etc. which are a potential source of inaccurate transmission of pedal motion to the potentiometer.

The present invention provides an assembled package which is easy to install using only straight forward nut and bolt mounting and a simple plug in wiring connection.

The present invention places all accelerator components in a protected environment and eliminates the need for mounting any control element in a more hostile environment. The design of this invention eliminates all lost motion between pedal movement and potentiometer movement. An interference fit is used between the potentiometer shaft and the pivot pin which eliminates the possibility of lost motion which would produce a variation in output voltage verses pedal position upon each pedal application.

The potentiometer drive shaft and the lever arm which translates the pedal motion into potentiometer motion are located relative to the potentiometer in a manner which eliminates mis-alignments and side-loads which could cause faulty or erratic potentiometer signal and eventual failure. The lever arm utilizes an H-shape which provides an even spreading of pedal operation over the width of the pedal and reduces the bending loads against bearings and enhances positional stability.

The lever arm idle stop contact point is profiled to match the stop pin which spreads the contact load over the widest possible area which eliminates wear of the lever arm stop and possible voltage change over time.

This invention allows the lever arm assembly compirising the lever arm and springs to be assembled to the pedal without first preloading the springs. This eliminates the possiblity of imposing an adverse load on the potentiometer shaft during assembly. After assembly of the lever arm to the pedal as described above, the lever arm can then be rotated until spring tension occurs and the idle stop pin is put into place to establish the idle position.

The roller of the this invention is designed with a crowned rolling surface which eliminates side load on the pedal which may occur if the roller and the track on which it travels are not flat to one another.

Further advantages and applications of the present invention will become apparent to those skilled in the art of electronic foot pedals when the accompaning description of one example of the best mode for practicing this invention is read in conjunction with the claims.

BRIEF DESCRIPTION OF THE DRAWING

The description herein makes reference to the accompaning drawing wherein like reference numbers refer to like parts throughout the various several views and wherein.

DESCRIPTION OF THE PREFERRED EMBODIMENT

Figure 1:
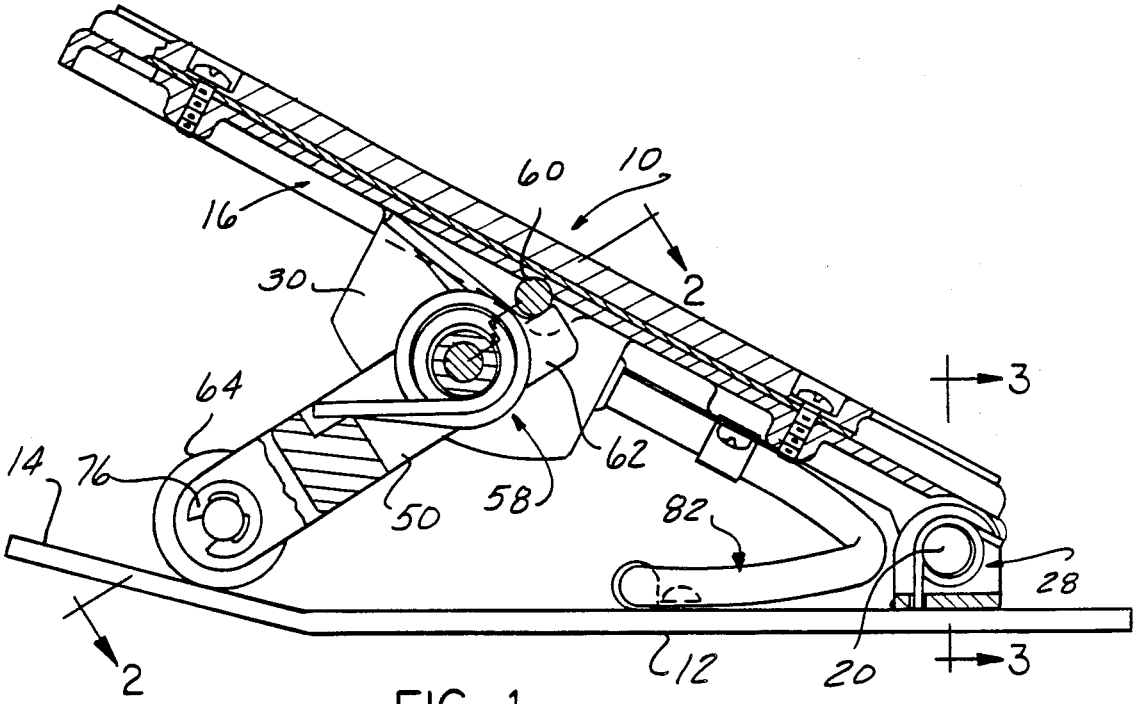
FIG. 1 illustrates a cross-sectional view of the foot pedal assembly of the present invention.
Figure 3:
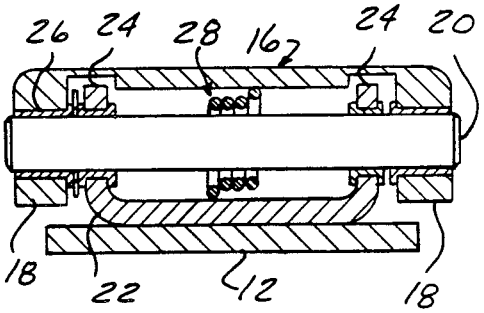
FIG. 3 illustrates a cross-section view of the foot pedal assembly of FIG. 1 taken along the lines 3—3 of FIG. 1.

Referring now to the drawing there is illustrated in FIG. 1 one example of the present invention in the form of an electronic foot pedal 10. The foot pedal 10 is adapted for generating an electronic signal which is representative of the angular position of the pedal. The foot pedal 10 comprises a base 12 having a track 14 at one end thereof. A pedal 16 is pivotably mounted at one end of the base 12. As shown in FIG. 3 of the drawing an end of the pedal 16 includes a pair of downward extending projections 18 which accommodate a pin 20 for pivotably mounting the pedal 16 to the base 12. A bracket 22 includes a pair of upwardly extending ends 24 which support the pin 20 and secure the bracket 22 to the base 12. A pair of bushings 26 snuggly engage a pair of aligned bores formed in the projections 18, and the inside diameter of the bushings 26 slidingly support the pin 20 allowing the pedal 16 to freely pivot relative to the base 12.

Figure 2:
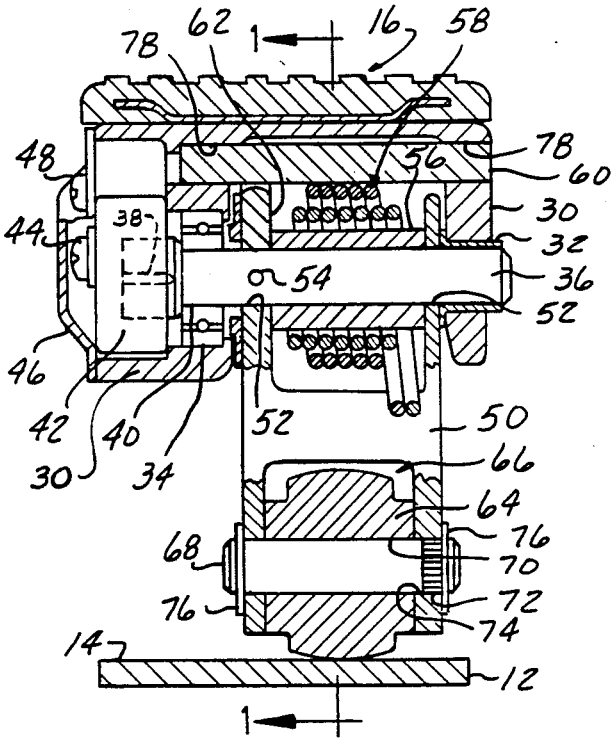
FIG. 2 illustrates a transverse cross-sectional view of the foot pedal taken along the lines 2—2 of FIG. 1.

As can best be shown in FIG. 2 of the drawing, the pedal 16 includes a pair of spaced-apart ears 30 formed thereon. The spaced-apart ears support a bushing 32 which is mounted in one ear and a ball bearing 34 which is mounted in the other ear. The bushing 32 and the bearing 34 support a pivot pin 36 so that the pivot pin 36 is free to rotate relative to the pedal 16. The pivot pin 36 includes at one end a slot 38 for snuggly engaging a tang 40 which is formed on the end of a shaft of a potentiometer 42. An adjusting screw 44 mounts the potentiometer 42 to the spaced-apart ear 30. Before the screw 44 is fully tightened, the body of the potentiometer 42 is rotated to the desired position and then held in that postion by tightening of the screw 44. A cover 46 encloses the potentiometer 42 and is held in place by a plurality of screws 48.

Still refering to FIG. 2 of the drawing, a lever arm 50 has an H-shape with a recess formed in the upper and lower portions thereof. A pair of aligned bores 52 are formed in upper end of lever arm 50. Said bores snuggly engage the pivot pin 36 to allow the lever arm to freely pivot relative to the pedal 16. The lever arm 50 is pinned to the pivot pin 36 by a cross pin 54. A hollow spacer 56 is placed in the upper recess of the lever arm 50 and is supported by the pivot pin 36. A lever bias means 58 surrounds the hollow spacer 56. The bias means 58 comprises two torsion springs nested one inside the other and abuting the lever at a lower end thereof and abuting the pedal at an upper end. Both springs urge the lever 50 toward an idle position. Two springs are used to provide a redundant bias so that if one spring is disabled the other has sufficient bias to urge the lever to an idle position. The idle position is established by a lever projection 62 which extends outward from the lever 50 abutting a stop pin 60 which is securly inserted in the spaced-apart ears 30.

A roller 64 is positioned in the lower recess 66 of the pivot arm 50 and is pivotably mounted to the lever arm by a roller pin 68. A bore 70 formed in the center of the roller 64 slidingly engages the pin 68. The pin 68 includes a knurled end 72 which is forced into a bore 74 of lever arm 50 to prevent rotation of the pin in operation. A pair of retaining rings 76 fit into groves formed in the roller pin 68 to prevent axial movement of the pin 68. The roller 64 has a crowned outside diameter to prevent sideloading of the lever 50 if there should be an out of parallel alignment of the axis of the pin 20 with the track 14.

Refering now to FIG. 1 of the drawing, it can be seen that bias means 58 is substantially stronger than bias means 28. Bias means 28 urges the pedal 16 toward a depressed position while bias means 58 urges the pedal toward an idle position. Bias means 28 is sufficiently strong to assure that the roller 64 remains in contact with the track 14 when the vehicle is traversing rough terrain and the operators foot may not be on the pedal. Bias means 28 is too weak to over power bias means 58 and depress the pedal without assistance from the operators foot.

Figure 4:
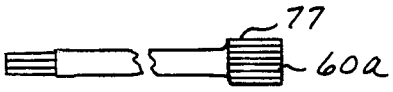
FIG. 4 illustrates an alternate configuration of the stop pin.
Figure 5:
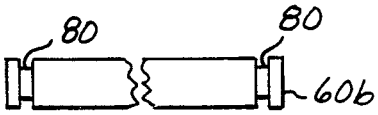
FIG. 5 illustrates another alternate configuration of the stop pin of FIG. 4.
Figure 6:
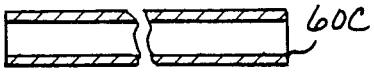
FIG. 6 illustrates a third alternate configuration of the stop pin of FIG. 4.

FIGS. 4,5 and 6 illustrate alternate configurations of the stop pin 60. FIG. 4 illustrates a stop pin having knurled ends 77 which are forced into aligned bores 78 formed in the ears 30. This configuration allows a wider tolerance for the bore 78 while the knurles on the pin 68 are forced into the bore and prevent its rotation and loosening during operation. Pin 60-B of FIG. 5 illustrates a pin having retaining ring grooves 80 formed in the ends thereof so that after the pin 60-B is inserted into the aligned bore 78 retaining rings are added to hold the pin 60-B in place. Pin 60-C comprises a spring pin which can be forced into the aligned bores 78 and the spring pin is forced to a smaller diameter and is self-retaining in the bores 78. This allows a wider tolerance for the bore 78 and lower manufacturing cost.

Refering again to FIG. 1 of the drawing, a cable 82 is connected at one end to terminals not shown which are part of the potentiometer 42. The other end of the cable 82 has a standard commercial multi-pin connector for interconnecting the cable 82 to the engine control.

It can thus be seen that the present invention has provided a new and improved electronic foot pedal which provides a voltage signal to diesel engine electronic fuel control systems in response to the drivers demand for engine power. The pedal assembly of the present invention is an integral unit which is cab mounted and connected to the engine fuel control by appropriate wiring harnesses and connectors. The present invention allows the electronic foot pedal to be mounted in a friendly environment free from the hostile environment of the engine compartment.

It should be noted by those skilled in the art of electronic foot pedal systems that other forms of the applicants invention may be had, all coming within the spirit of the invention and the scope of the claims.

Having thus described my invention, what I claim is:

1. A foot pedal assembly for generating an electrical signal which is representative of the angular position of a pedal comprising:

a base having a track;

a pedal having upper and lower sides, said pedal pivotally mounted above said base and adapted to be pivoted toward and away from said track;

a lever arm having upper and lower ends, the upper end pivotably mounted on the lower side of said pedal, said lever arm including a bearing means at the lower end of the lever arm, said bearing means engaging said track and being forced to move between a depressed and an idle position along said track upon respective pivotal movement of the pedal toward and away from said track;

a potentiometer carried on one of said lever arm and pedal which is responsive to the relative pivoting movement therebetween for generating an electrical signal representative of the angular position of said pedal;

spring biasing means biasing said lever arm toward the idle position, said spring biasing means having a pre-loaded condition in said idle position, and a stop member mounted on said pedal for engaging the lever arm and stopping the spring biasing movement of the lever arm at said idle position, said stop member being removably mounted to said pedal whereby the lever arm and spring biasing means can be mounted to said pedal with the stop member removed and with the spring biasing means in an unloaded condition to be thereafter pivoted past the idle position and toward said depressed position for mounting the stop member to the pedal.

2. A foot pedal assembly as defined in claim 1 wherein said stop member is a pin mounted between ears provided on said pedal.

* * * * *